United States Patent [19]

Peterson

[11] 4,165,042

[45] Aug. 21, 1979

[54] ROTARY JAW CRUSHER

[75] Inventor: Carl R. Peterson, Boxford, Mass.

[73] Assignee: The United States of America as represented by the Secretary of the Interior, Washington, D.C.

[21] Appl. No.: 895,694

[22] Filed: Apr. 12, 1978

[51] Int. Cl.[2] ..... B02C 13/02

[52] U.S. Cl. ..... 241/198 A; 241/204; 241/208; 241/265

[58] Field of Search ..... 241/198 A, 203, 204, 241/207, 208, 264, 265, 266

[56] References Cited

U.S. PATENT DOCUMENTS

| | | | |
|---|---|---|---|
| 1,946,763 | 2/1934 | Sallwasser | 241/198 A UX |
| 2,582,734 | 1/1952 | Adams | 241/208 X |
| 2,588,180 | 3/1952 | Traylor, Jr. | 241/265 X |
| 3,229,922 | 1/1966 | Weiss et al. | 241/204 |
| 3,503,563 | 3/1970 | Daly | 241/204 |

*Primary Examiner*—Howard N. Goldberg
*Attorney, Agent, or Firm*—Thomas Zack; Donald A. Gardiner

[57] ABSTRACT

A portable hard rock crusher unit especially useful for low clearance underground mines. Material to be crushed is horizontally fed to the rotary crusher jaws. A curved convergent material flow-path is employed between two crusher jaws. The outer member of the crusher is a substantially stationary outer curved concave jaw and its inner jaw member is a cylindrical element mounted to give eccentric motion on a shaft. The inner member may freely rotate on its eccentric or it may also be rotatably driven. Material fed between the inner and outer jaw members of the crusher encounters a progressively narrower opening as it is crushed and moved by the peristaltic pumping action caused by the eccentric motion of the movable inner crusher element acting against the outer stationary jaw.

6 Claims, 5 Drawing Figures

ROTARY JAW CRUSHER

BACKGROUND OF THE INVENTION

1. Field of the Invention

The invention is a rotary jaw crusher.

2. Description of the Prior Art

The closest known prior art to this invention is the "Gyrozontal Crusher" manufactured by the Eagle Crusher Company of Galion, Ohio. In similar fashion with my invention this prior crusher employs an eccentrically mounted rotatable roller and a curved stationary plate. Actually the crusher has two opposed plates one of which is concave and the other convex with the rotatable roller of about the same curvature and size centered therebetween. Although there are some similar structural characteristics, there are also important structural and functional differences from the present invention. Structurally my invention employs only a single large concave stationary jaw extending about 120 degrees around a rotatable roller towards its lower side. Functionally, this design allows the material to be horizontally supplied to the crusher rather than vertically as in the Gyrozontal Crusher.

Jaw crushers now in widespread use have proven to be satisfactory for most of their intended purposes such as their feed size, hard rock capability, reduction ratio, product characteristics, throughput, and economy. However, in mines and other areas where headroom is a problem these crushers with their conventional top feed arrangement required too much headroom, particularly if slabby material (which would have to be vertically oriented) is to be handled. Several horizontal feed jaw crushers have been used in which the conventional crushers are simply placed on their edge. With this arrangement a horizontal chain conveyor travels just beneath the lower edge of the jaws to move material through the machine. FIGS. 1 and 2 illustrate, respectively, a top and side view of this kind of prior art setup. This type of feed arrangement, which is different from the uniform gravity feed of the standard upright configuration, causes a migration of the finer material normal to the thruflow direction, thus encouraging early choking in the vicinity of the chain conveyor. To overcome these problems this invention employs a specially construction rotary jaw crusher which employs a curved flow path to both decrease the vertical dimension of the jaws themselves and to provide for a horizontal feed without the above problems.

SUMMARY OF THE INVENTION

The horizontally fed rotary jaw crusher making up this invention has a concave curved outer substantially stationary jaw and a smaller diameter inner freely rotatable jaw. This rotatable jaw is mounted for eccentric motion through its hollow center. In turn the shaft's center is located below the center line of the curved surface forming the stationary outer jaw so that material entering the crusher between its two jaws is forced into a narrower and narrower opening as it travels through the machine.

The primary object of this invention is an improved rotary jaw crusher.

Figure 3:
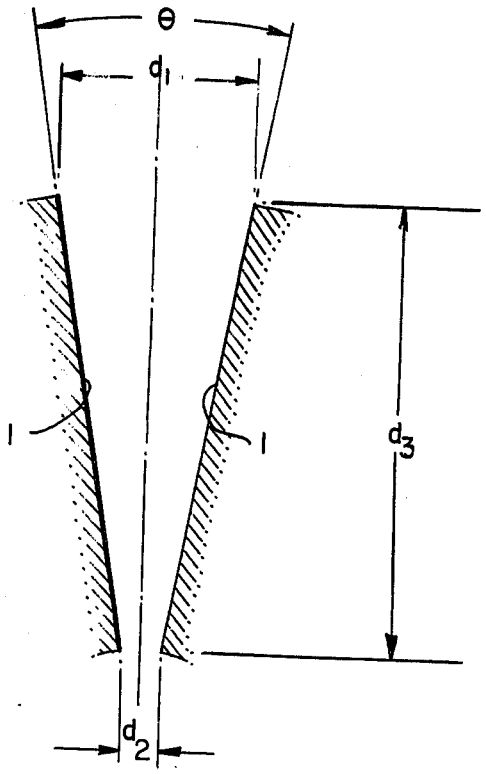
FIG 3. (PRIOR ART)

FIG. 3 schematically depicts in cross-section a typical prior art vertical feed jaw crusher.

Figure 4:
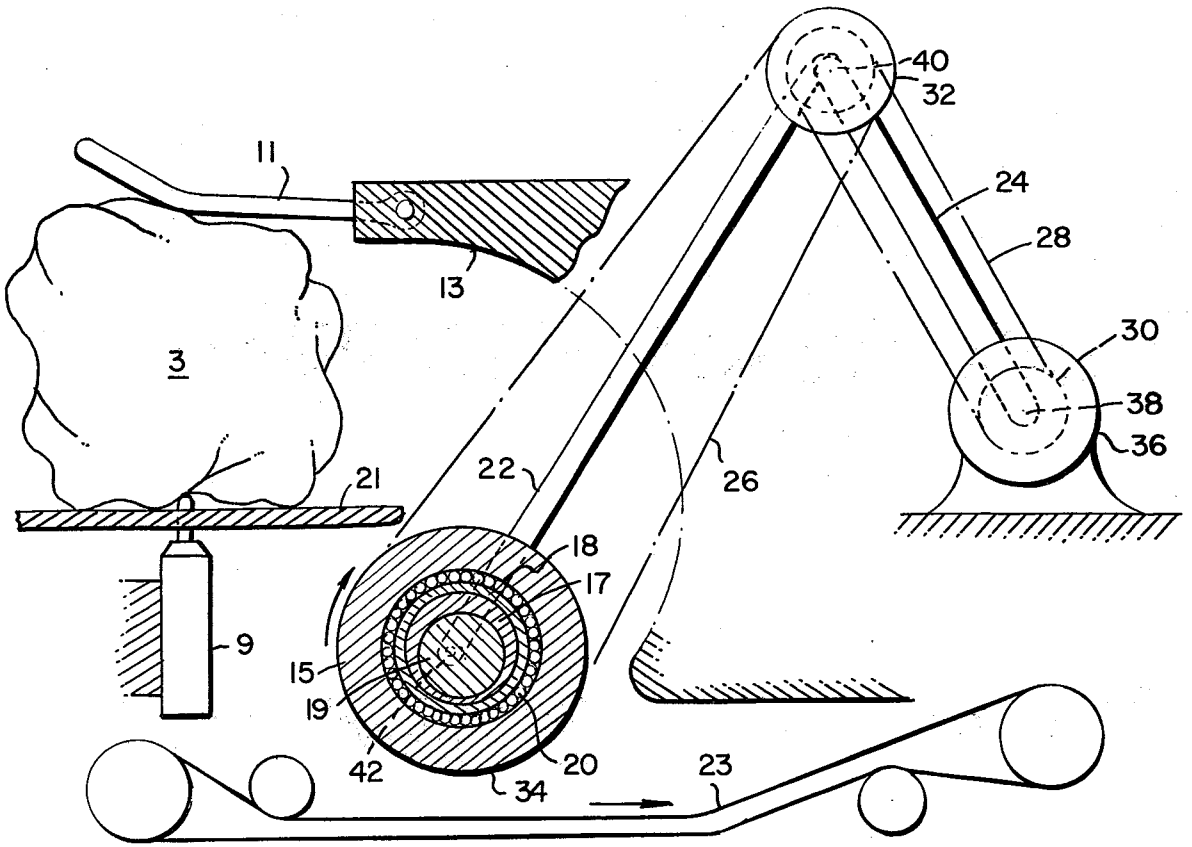

FIG. 4 schematically illustrates in cross-section the preferred embodiment of this invention combined with an optional drive for the inner jaw, an oversized breaker, and a material intake and a conveyor system.

Figure 5:
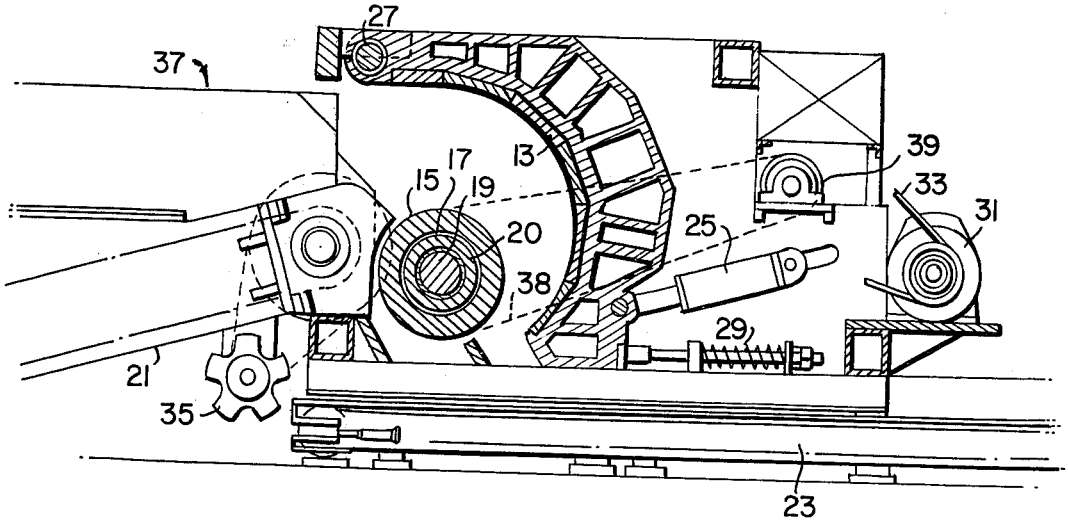

FIG. 5 shows how the preferred embodiment of our crusher, without the FIG. 4 oversized breaker, or optional drive could be incorporated into a rock crushing system.

The work resulting in this invention was performed under contract with the United States Bureau of Mines as detailed in the final report from Rapidex Inc. entitled "Application Study Of Portable Underground Hardrock Crushers" first released for publication on Apr. 12, 1977.

Figure 1:
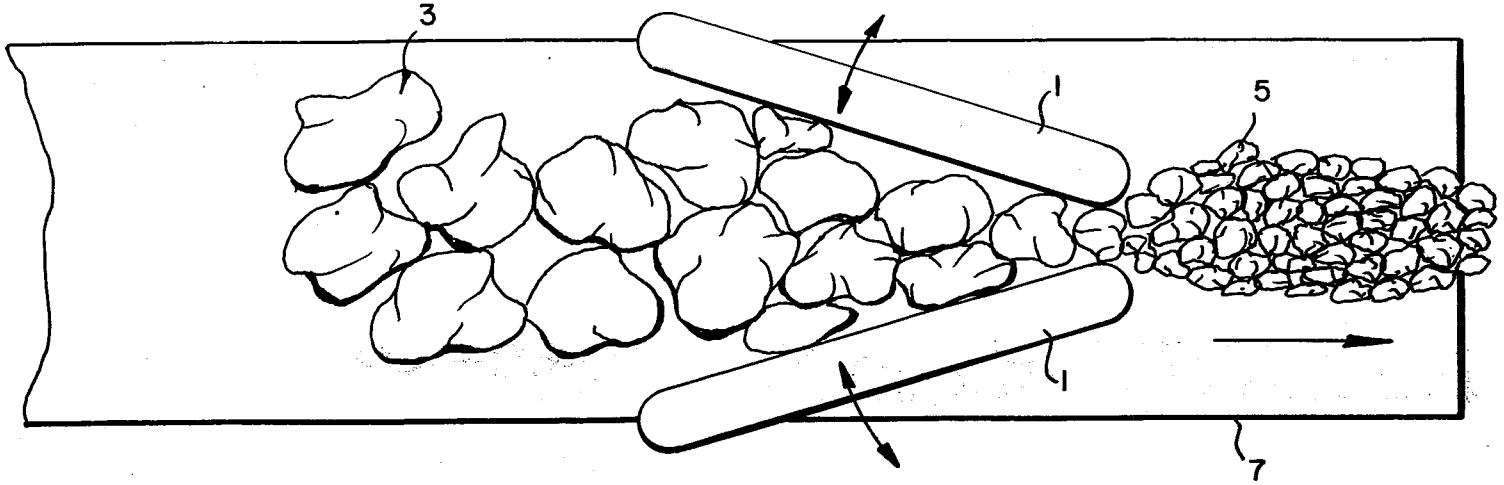
FIG 1. (PRIOR ART)
FIG. 1 is an elevated view of a typical system employing a prior art horizontal feed jaw crusher.
Figure 2:
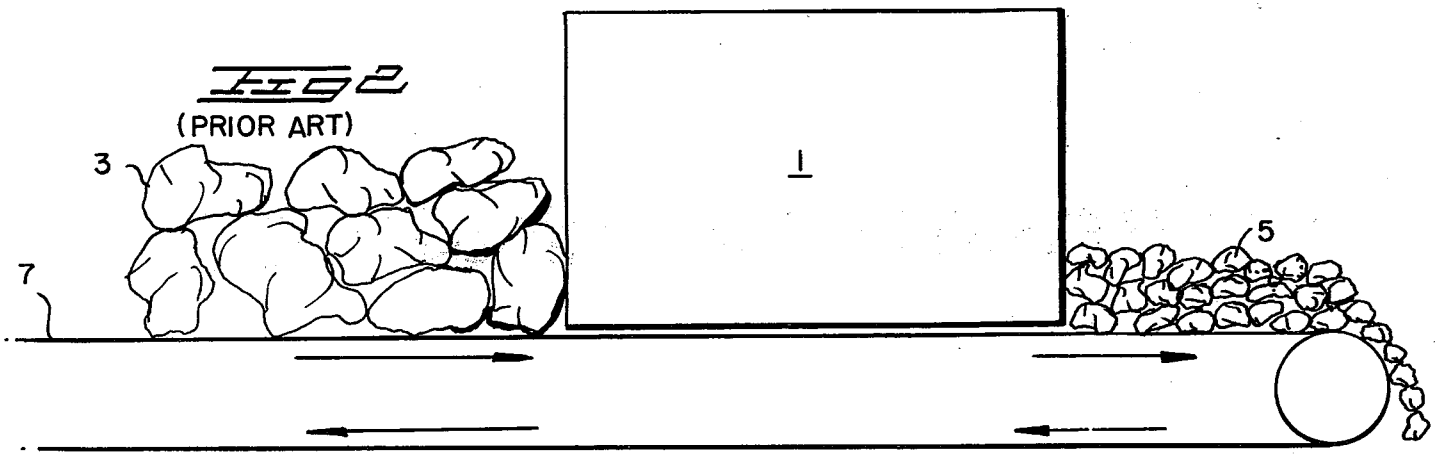
FIG 2 (PRIOR ART)
FIG. 2 is a side view of the FIG. 1 system.

The prior art horizontal feed system of FIGS. 1 and 2 has two oscillating jaws 1 which move in the direction of the arrows as shown. Large rocks 3 fed into the jaws at the converging entrance of the two opened jaws are progressively crushed so that they emerge as the smaller crushed discharge 5. Powered endless conveyor 7 moves the rocks in the direction of the arrows—from left to right in the figures—to the point of discharge located at the right most side.

The more or less typical vertical fed prior art crusher of FIG. 3 would have a angle $\theta$ at the opening that would be about 20 degrees. If the inlet distance $d_1$ is 30 inches and the discharge $d_2$ is 6 inches, then the bare jaw height $d_3$ must be 69 inches.

In the FIG. 4 schematic of a rotary jaw crusher illustrating the preferred embodiment of this invention, an equivalent jaw crusher is cross-sectionally shown in which inlet and discharge dimensions and mean path lenth (hence convergence angle) are preserved while wrapping the mean path around a 120 degree curve. Using the same numbers and comparing the FIG. 3 typical embodiment dimension with those dimensions indicated, it can be shown the curved path design results in a decrease of 9 inches in height. In addition to this height savings, this configuration provides the distinct advantage of horizontal feed thereby allowing its use in confined mine locations.

Before discussing the specific details of this invention, mention should be made of the related oversized breaker. Basically this breaker is made up of the impactor or hydraulic hammer 9 and the upper triggering gate 11. The gate acts as a holder-sensor to hold and relay to the hammer than an oversized rock is present that cannot be handled by the downstream crusher, that this oversized rock is in the proper position for breaking, and that the rock has or has not been broken after struck by the impactor. Once properly broken the rock passes under the gate. Ideally, the impactor once actuated seeks to break the oversized rock with one long stroke of its piston. Thus, the impactor is to use a single stroke of about 12 inches in length with a high impact velocity to strike the rock from below, to allow the reaction to the stroke to come solely from the inertia of the fragment itself, and to permit the broken fragments to be conveyed to the rotary jaw crusher. Rocks below a minimum size slip under the oversize breaker's gate and are unaffected by it and its impactor and go directly to the rotary crusher.

Although several methods may be used to provide the actual crushing action of the FIG. 4 embodiment, the preferred one utilizes an inner element crushing motion. With this system there is a relatively large outer concave stationary jaw 13 and an inner smaller jaw 15 between which the material to be crushed passes.

In the preferred embodiment the inner jaw is a cylindrical roller—shown in cross section—with a hollowed out center portion. Beginning at the innermost portion of the hollow jaw there is shown the rotatably driven solid center shaft 19. For simplicity purposes the pulley and belt drive for the center shaft have not been shown in FIG. 4 (See FIG. 5). Fixed to the outer surface of this center rotating shaft is the eccentric mount 17 which rotates in unison therewith. This eccentric may take many forms such, as depicted, a cylinder with a hollow circular interior extending lengthwise in the same direction as to the shaft and jaw. This hollowed interior engages and is fixed to the shaft 19. However, the center of the hollowed out interior of the eccentric is offset from the center of the outer surface of the eccentric. External of the eccentric is an annulus band 18 or similar guideway that encircles the eccentric and moves in unison with it. Still further away from the center shaft riding in the guideway formed by band 18 is a continuous series of separate circularly disposed ball bearings 20 which allow the jaw 15 to freely turn with respect to the inner shaft 19. When these jaws crush the rocks, the rotation of the inner jaw about its eccentric will as a consequence be random and controlled by the crushing forces exerted by the rock fragments on the outer surface of the cylindrical roller jaw 15.

In an alternate embodiment, superimposed on FIG. 4 the inner jaw may, as an option, be mounted to accomplish the same eccentric action but also be separately powered to rotate slowly in the throughflow direction as shown to enhance the flow of material through the crusher.

The drive to rotate the inner jaw may be conventional such as the illustrated dancer drive with a belt (or chain) and links. With such a drive there are two rigid link arms 22 and 24, two endless belts (or chains) 26 and 28 which engage and rotate with three pulleys (30, 32 and 34) at their extended change-of-direction end portions. Drive motor 36 provides the power to rotate pulley 30 and belt 28, etc. Pivots 38, 40, and 42 join each of the link arms to, respectively, the motor 36, themselves, and the center shaft 19. At the latter junction the end of the link (22) is centered on the eccentric 17. As described it can be seen that the dancer drive provides a positive constant drive for the inner jaw despite its eccentric mounted. Thus, belts 26 and 28 are under tension at all times and variations due to the eccentric are compensated for by the pivotal mountings of the link arms. With this latter embodiment, the rotational speed of the inner cylindrical jaw may be much lower than the speed of the shaft.

It is believed the non-driven freely orbiting motion will require less force than would oscillation of the outer jaw and less force than conventional designs having jaws which converge everywhere simultaneously. The center of rotation of the inner jaw is substantially lower than the major portion of the outer stationary jaw. One additional advantage this type of crushing action has over the conventional gravity feed crusher (FIG. 3) relates to the characteristic of such a crusher of making it virtually certain rock fragments will in fact be tightly lodged throughout the converging zone simultaneously as the crushing stroke commences. In contrast, the orbiting inner crushing jaw produces only a local zone of maximum convergence which travels through the rock charge. Hence, although the FIG. 4 embodiment provides for crushing in approximately 120 degrees of eccentric motion it does not crush the entire charge simultaneously. This would insure a more uniform force spread thru the full rotatation of the shaft rather than a peak force near full convergence. It also provides for lateral circumferential displacement of material from the local crushing zone, tending to substantially reduce peak forces under conditions which would choke a conventional design.

Still another advantage is presented by the FIG. 4 crushing system. With material flow and rotation in the directions shown, the rock charge will be subjected to the crushing action as it moves through the rock providing a peristaltic pumping action to assist throughput. Balanced wear can also be provided between the jaws by making the full circumference of the inner jaw about equal to the total surface length of the outer jaw.

FIG. 5 depicts the preferred embodiment of the FIG. 4 rock crusher incorporated into a rock crushing system. The same numbers have been used to designate the same parts in both figures, however, for simplicity purposes the oversized breaker and optional drive have not been shown in FIG. 5. The upper feed input conveyor system 21 and the lower discharge system 23 used to move material to and from the crusher are conventional and per se form no part of this invention. It is, of course, possible for the related unique oversized breaker of FIG. 4 to be used with the system, but it too is a separate and distinct feature therefrom. In the preferred embodiment of the rock crusher the outer jaw 13 has been referred to as stationary. For most cases this will in fact be the situation. However, when the stationary jaw is subjected to excessive forces a large "back-up" hydraulic cylinder 25 (FIG. 5) can be used to permit some "give" or movement of the jaw. This cylinder works in conjunction with the fixed pivot joint 27 and the horizontal spring biased retaining rod 29 to allow a restrained movement in a counterclockwise direction of the jaw 13 when it is under the influence of an excessive force during its crushing cycle. Other self-explanatory conventional features shown in FIG. 5 include the electric drive motor 31 connected via its belt 33 to the drive pulley 39 for shaft 19; the infeed conveyor drive 35 for the conveyor 21; the material input feed hopper 37; and, the pulley 39 for connecting a belt drive 38 to center shaft 19. Each of the jaw's material engaging surfaces may also be replaceable or the inner jaw may have ribbed outer surfaces to assist in moving the material.

None of these disclosed features of the preferred or alternate embodiments should be used to limit the scope and extent of this invention which is to be measured only by the claims that follow.

I claim:

1. A generally horizontally fed rotary jaw crusher assembly comprising:

horizontal feed means for feeding the material to be crushed in a generally horizontal direction to the cursher;

a large outer stationary jaw having a concave curved material engaging surface;

a smaller inner rotatable jaw having an outer continuous material engaging curved surface and a hollow center portion adapted to receive a center driven shaft about which it can rotate, said inner and outer jaw being located with respect to each other such that at least along a portion of their two material engaging surfaces there is formed a passageway of progressively narrow width into which all of the material to be curshed is fed from the horizontal feed means in a generally horizontal direction;

the center driven shaft adapted for use with the inner jaw being rotatable about its own center axis and smaller in diameter than said inner jaw's hollow center portion and mounted therein;

eccentric means connected to and moveable with said driven shaft for causing the eccentric motion of said inner jaw's material engaging surface about the center of said driven shaft; and means located between the eccentric means and inner jaw material engaging surface for allowing the inner jaw's material engaging surface to freely rotate about the center shaft whereby material fed between the inner jaw and the outer jaw is subjected to a peristaltic pumping crushing action.

2. The crusher of claim 1 wherein the outer continuous material engaging surface of the inner jaw forms a generally circular configuration when viewed in cross-section.

3. The crusher of claim 2 wherein the measured total cross-sectional distance around the inner jaw's material engaging surface is about the same as the total measured cross-sectional distance around the material engaging surface of the outer jaw.

4. The crusher of claim 1 also including means for rotating the material engaging surface of the inner jaw at a speed independent of the driven speed of said center shaft.

5. The crusher of claim 1 including excessive force absorbing means mounted on said outer substantially stationary jaw for allowing the movement thereof when subjected to excessive forces from the material to be crushed.

6. The crusher of claim 5 wherein said absorbing means comprises hydraulic cylinder means and biasing means to return the outer jaw to its original position when the excessive force is removed.

* * * * *